US005593514A

United States Patent [19]

Giessen et al.

[11] Patent Number: 5,593,514

[45] Date of Patent: Jan. 14, 1997

[54] AMORPHOUS METAL ALLOYS RICH IN NOBLE METALS PREPARED BY RAPID SOLIDIFICATION PROCESSING

[75] Inventors: Bill C. Giessen, Cambridge; Sunil V. Gokhale, North Chelmsford; Krassimir G. Marchev, Boston, all of Mass.

[73] Assignee: Northeastern University, Boston, Mass.

[21] Appl. No.: 348,017

[22] Filed: Dec. 1, 1994

[51] Int. Cl.[6] ..... C22C 5/02; C22C 5/04; C22C 5/06; C22C 45/00

[52] U.S. Cl. ..... 148/403; 420/462; 420/502; 420/507; 420/511

[58] Field of Search ..... 148/403; 420/461–468, 420/501, 502, 503, 505, 507–511

[56] References Cited

U.S. PATENT DOCUMENTS

| | | | |
|---|---|---|---|
| 3,994,718 | 11/1976 | Berndt et al. | 75/84.1 |
| 4,082,547 | 4/1978 | Berndt et al. | 75/122.7 |
| 4,116,682 | 9/1978 | Polk et al. | 75/123 |
| 4,339,270 | 7/1982 | Hashimoto et al. | 148/403 |
| 4,540,546 | 9/1985 | Giessen | 420/590 |
| 4,560,454 | 12/1985 | Harris et al. | 204/128 |
| 4,564,396 | 1/1986 | Johnson et al. | 148/4 |
| 4,728,580 | 3/1988 | Grasselli et al. | 148/403 |
| 4,743,513 | 5/1988 | Scruggs | 428/668 |
| 4,746,584 | 5/1988 | Tenhover et al. | 428/670 |
| 4,770,949 | 9/1988 | Hashimoto et al. | 428/687 |
| 4,781,803 | 11/1988 | Harris et al. | 204/129 |
| 4,810,314 | 3/1989 | Henderson et al. | 148/403 |
| 4,923,770 | 5/1990 | Grasselli et al. | 429/101 |
| 5,022,932 | 6/1991 | Yamada et al. | 148/13.1 |

FOREIGN PATENT DOCUMENTS

| | | | |
|---|---|---|---|
| 56-105454 | 8/1981 | Japan | 148/403 |

OTHER PUBLICATIONS

Gokhale et al., "$Au_{.80}Cu_{.10}Y_{.10}$, A Gold–Rich Ternary Alloy Glass with $T_c$>400°C. and its Crystallization Kinetics", *Amorphous Materials; Ceramics, Metals, Polymers, and Semiconductors,* Mat. Res. Soc. Symp. 321:1–6, Dec. 1993.

*Primary Examiner*—George Wyszomierski

*Attorney, Agent, or Firm*—Weingarten, Schurgin, Gagnebin & Hayes, LLP

[57] ABSTRACT

Amorphous metal alloys rich in noble metals prepared by rapid solidification processing are disclosed. The alloys have at least a ternary composition having the formula $M_aG1_bG2_c$, wherein M is at least one element selected from the group consisting of Ag, Au, Ru, Os, Rh, Ir, Pd, and Pt, and G1 is at least one element selected from the group consisting of B, C, Cu, Ni, Si, and Be, and G2 is at least one element selected from the group consisting of Y, the lanthanides, Zr, Hf, Ca, Mg, Ti, Nb, and Ta. The subscripts a, b, and c are atomic percentages; a ranges from 70 to 90 percent, and b and c range from 5 to 15 percent each. Preferably, a is at least 80 percent and b and c are generally equal. The amorphous metal alloys are readily glass forming and thermally stable at room temperatures.

16 Claims, 3 Drawing Sheets

X-ray diffraction pattern of amorphous $Au_{.80}Cu_{.10}Y_{.10}$ taken with Cu-Kα radiation. Only first broad peak with maximum at 2θ≈38.3° is shown (see text).

X-ray diffraction pattern of amorphous $Au_{.80}Cu_{.10}Y_{.10}$ taken with Cu-Kα radiation. Only first broad peak with maximum at 2θ≈38.3° is shown (see text).

DSC scan of amorphous $Au_{.80}Cu_{.10}Y_{.10}$ taken at 40 K/min, showing crystallization exotherm at 685 K and pre-crystallization exothermic activity at~650 K.

Kissinger plot [17] analysis of DSC scans similar to the one shown in FIG. 2 taken at the cooling rates $\dot{T}$ (K/min) indicated in the figure. Plot shows $\ln T^2_{max}/\dot{T}$ vs. $1000/T_{max}$, where $T_{max}$ is the temperature at maximum of exotherm.

AMORPHOUS METAL ALLOYS RICH IN NOBLE METALS PREPARED BY RAPID SOLIDIFICATION PROCESSING

FIELD OF THE INVENTION

This invention relates to amorphous metal alloys and more particularly to amorphous metal alloys rich in noble metals that can be prepared by rapid solidification processing.

BACKGROUND OF THE INVENTION

Amorphous solids are those which have no crystalline structure or long range order. Silicate glasses are a common example of an amorphous solid, but other materials can form amorphous structures as well. For example, certain metal alloys can solidify to an amorphous state upon rapid cooling from a melt. Such metal alloys are known as amorphous or glassy metals.

Although a number of amorphous metals are known, they have found only limited commercial usefulness other than as a magnetic material, discussed below. Amorphous materials are often thermally instable, i.e., they crystallize at relatively low temperatures. Some amorphous metals are particularly brittle, which limits their use in applications requiring a ductile material. Also, some glass-forming compositions can be made amorphous only with difficulty. The widest commercial use made of amorphous metals to date has been as a soft magnetic material in transformers. In particular, the alloy formed by rapid quenching of an Fe-Ni melt with additions of metalloids such as B or P has yielded an amorphous metal suitable for this purpose.

U.S. Pat. No. 4,116,682 discloses a class of amorphous metal alloys of a ternary composition rich in Fe, Ni, Co, Cr, or Mn, but differing from the Fe-Ni glasses of the previous paragraph in that there are at least two glass forming additives present, which are chosen from two different groups of elements, one of which comprises a larger atomic size element such as Zr or Y and the other of which comprises a smaller atomic size element such as B, with the elements from both groups acting synergistically to produce glasses low in total additive concentrations (under 25 atomic percent of total additive). Al-based, Al-rich ternary compositions which are glass forming and contain representatives of two different additive groups are also known.

Among noble metal element alloys, especially those based on Ag and Au, $Au_{80}Si_{20}$ is known to be readily glass forming, but this glass is not thermally stable at room temperature. The known glassy metal $Au_{80}Ge_{12}Si_{08}$ has a temperature of crystallization $T_c$ of 307K. Binary Au-lanthanide systems form more thermally stable glasses, but require high concentrations, approximately 40 percent, of the additive elements for glass formation. Ag is notorious for being a poorly glass forming element; the only known binary glass-forming, Ag-rich alloys contain the divalent lanthanides Eu or Yb as additives, containing less than 82 atomic percent Ag. (It should be noted that both Eu and Yb are expensive addition elements.) Thus, amorphous metal alloys comprising at least 70 percent of the noble metals Ag and Au do not form upon rapid quenching at the cooling rates of melt-spinning, discussed below, or are not long-term thermally stable at room temperatures, or contain expensive addition elements. For some of the other noble metals, glass forming compositions are known, but, except for $Pd_{80}Si_{20}$, these are generally not rich in the noble metals.

In the metallic glasses in general, and in the noble metal glasses contemplated in this invention in particular, there are advantages to obtaining compositions rich in the majority metal component or components (in the case of mixtures, e.g., of noble metals), because in such compositions the desirable characteristics of the majority component or components (magnetic, corrosion resistance, ductility, color and visual appearance) are most likely to be retained in the glassy state.

Amorphous solids may be formed by several processes. For bulk materials, the most commercially useful processes use liquid quenching techniques, in which a melt of the alloy composition is cooled rapidly, generally at a rate greater than $10^5$ K/s, so that no crystalline structure forms. The melt spinning technique, a type of liquid quenching, directs a stream of melt toward a rapidly spinning wheel, upon which the melt solidifies and is formed into a ribbon. Other processes, which are unsuitable for bulk quantity production, include vapor deposition processes, such as thermal vapor deposition and sputtering. Last, electroless chemical deposition is suitable only for certain elements not containing the noble metals.

Thus, there is a need for formulating alloy compositions rich in the noble metals, especially Au and Ag, that could be readily glass forming upon quenching from the liquid at cooling rates obtainable by melt spinning.

SUMMARY OF THE INVENTION

The present invention provides amorphous metal alloys rich in noble metals. The amorphous metal alloys have at least a ternary composition containing 70 to 90 atomic percent noble metals and preferably at least 80 atomic percent. The alloying metals are chosen from two groups: an element having an atomic radius smaller than the noble metal, such as B, C, Cu, Ni, Si, and Be, and an element having an atomic radius larger than the noble metal, such as Y, the lanthanides, Zr, Hf, Ca, Mg, Ti, Nb, and Ta. The elements from the latter two groups are provided in generally equal amounts, with at least 5 atomic percent of each. The amorphous metals are readily glass forming by rapid solidification processes and have crystallization temperatures $T_c$ sufficiently high to ensure long metastable life times at room temperatures.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
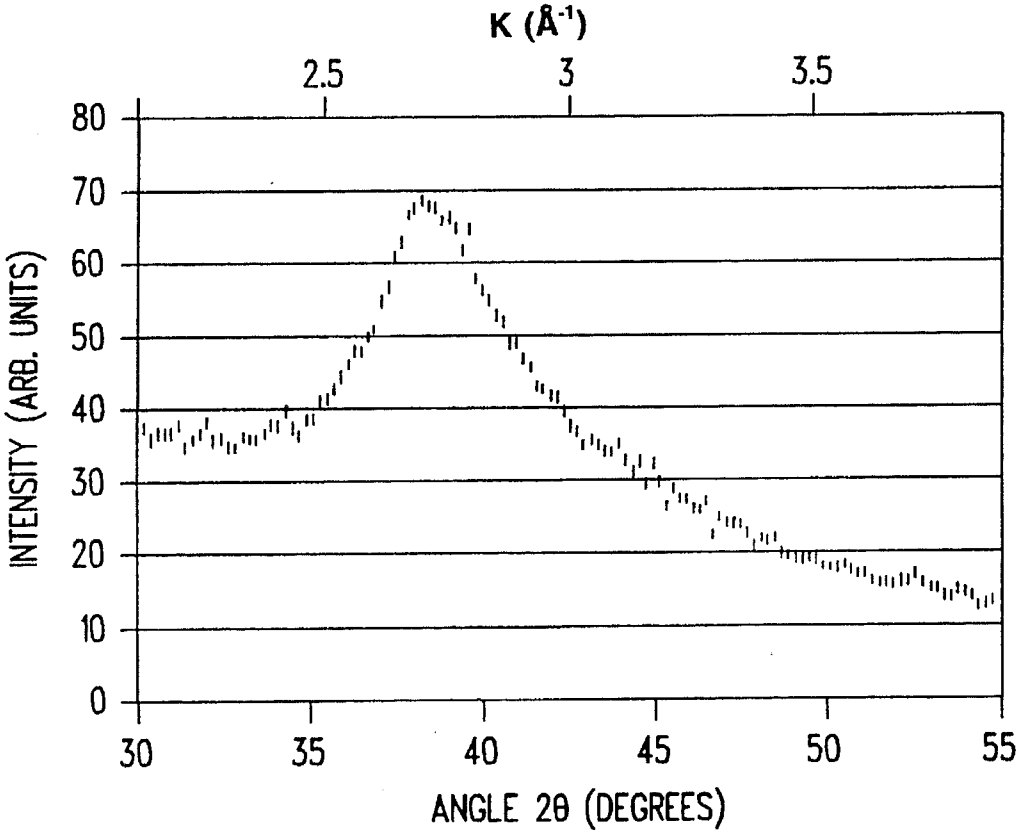
FIG. 1 is an X-ray diffraction pattern of amorphous $Au_{80}Cu_{10}Y_{10}$ according to the present invention.

The class of amorphous metal alloys of the present invention is rich in noble metals. That is, the noble metals comprise between 70 and 90 atomic percent, and preferably approximately 80 to 85 atomic percent, of the composition. The metal alloys have at least a ternary composition having the formula $M_aG1_bG2_c$. M is at least one element selected from the group consisting of the noble metals Ag, Au, Ru, Os, Rh, Ir, Pd, and Pt. G1, the first glass forming additive, is at least one element having an atomic radius smaller than the atomic radius of the noble metal. G1 is selected from the group consisting of B, C, Cu, Ni, Si, and Be. G2, the second glass forming additive, is at least one element having an atomic radius larger than the atomic radius of the noble metal. G2 is selected from the group consisting of Y, the lanthanides (sometimes described as the rare earths (REs)), Zr, Hf, Ca, Mg, Ti, Nb, and Ta. The subscripts a, b, and c refer to atomic percentages; a ranges from 70 to 90 percent, and b and c range from 5 to 15 percent. The sum of a+b+c is always 100 percent. Preferably, a is at least 80 percent, and b and c are generally equal in atomic percent. Several Au- and Ag-rich glasses and a Ru-rich glass have been produced according to the present invention using at least two glass forming additives, one additive being an element having an atomic radius smaller than Au, Ag, or Ru and the other being an element having an atomic radius larger than Au, Ag, or Ru. The alloys were found to be thermally stable at temperatures at least as high as 550K for Au-rich glasses, 650K for Ag-rich glasses, and 1000K for Ru-rich glasses.

For the Au-rich glasses, the preferred smaller glass forming additive is Cu or Si. The preferred larger glass forming additive is selected from the group consisting of Y, the lanthanides, and the Group IV transition metals Ti, Zr, and Hf. Each of the Au-rich glasses was found to be readily glass forming by rapid solidification processing. The glasses were found to be thermally stable at temperatures below 550K.

EXAMPLE 1

The alloy $Au_{80}Cu_{10}Y_{10}$ was prepared by the arc furnace quenching technique. Alloy buttons were arc-melted and small alloy quantities were quenched by an arc-furnace hammer and anvil device, as is known in the art. This technique provides cooling rates similar to the commercially preferable melt spinning method. The alloy was found to be readily glass forming. Glass formation was determined by X-ray diffraction (XRD) and differential scanning calorimetry (DSC).

FIG. 1 shows an X-ray diffraction pattern of amorphous $Au_{80}Cu_{10}Y_{10}$ taken with Cu-K$\alpha$ radiation. Only the first broad peak with a maximum intensity at $2\theta \approx 38.3°$ is shown, illustrating the important low-k region ($k=4\pi\sin\theta/\lambda=2.1$ to 3.8). Glass formation is clearly indicated by the first broad peak, which is exceptionally wide and accordingly indicative of the large range of interatomic distances present in glasses.

Figure 2:
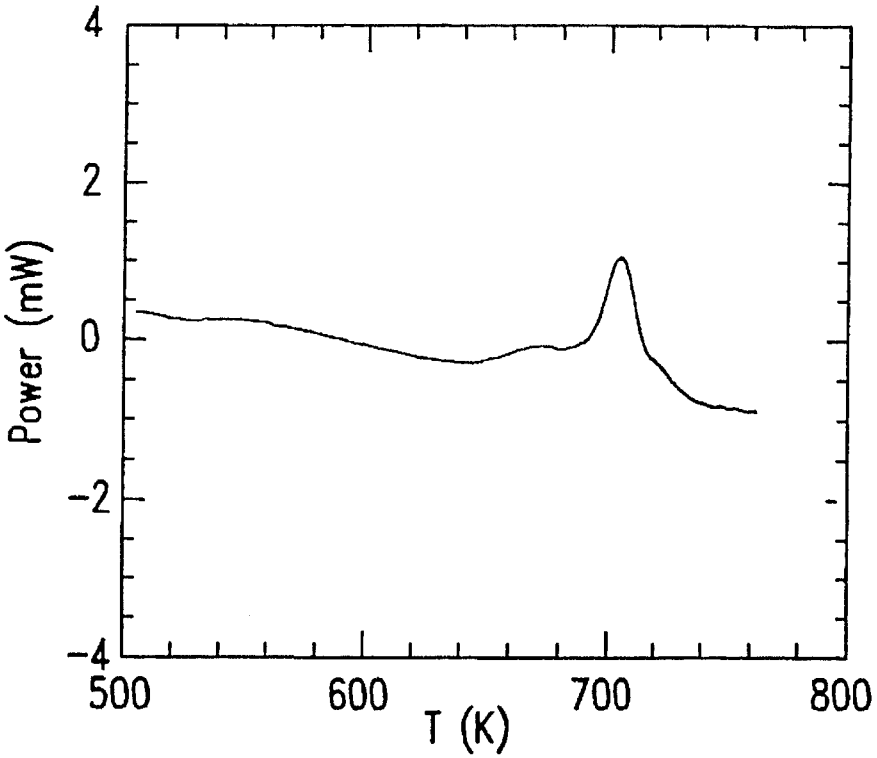
FIG. 2 is a differential scanning calorimetry scan of the amorphous $Au_{80}Cu_{10}Y_{10}$ of FIG. 1.

A differential scanning calorimetry scan taken at T=40K/min is shown in FIG. 2. The crystallization temperature $T_c$ for $Au_{80}Cu_{10}Y_{10}$ is 685K (412° C.) (for T=40K/min), which indicates a sufficiently long-term (meta) stability at room temperature for potential usefulness in applications.

Crystallization is often preceded by unidentified exothermic activity beginning at ~650K, followed by crystallization at $T_c$. The higher resistance to crystallization of the new glasses compared to the previous gold glasses is their most significant feature.

The crystallization temperature $T_c$ of the glass of the present invention was also compared to the solidus temperature of the corresponding multiphase crystalline alloy, which in this case was estimated as the eutectic temperature $T_E$ in the pseudobinary system $(Au_{.189}Cu_{.11})_{90}Y_{10}$. (Typical $T_c/T_E$ values for metallic glasses lie between 0.44 and 0.68). In the absence of a ternary diagram for the glass of the present invention, $T_E$ was estimated from the corresponding binary phase diagrams (using that of the crystal chemically related Au-Dy system in place of the undetermined Au-Y phase diagram), obtaining $T_E=1055\pm35$K. This yields $T_c/T_E=0.65\pm0.2$. For comparison, $T_c/T_E=0.48$ for the prior art glassy metal $Au_{80}Ge_{12}Si_{08}$. Thus, the glass of the present invention exhibits greater thermal stability even after this normalization procedure. The higher $T_c$ of the Au glass of the present invention is believed to be due to its content of additional metals with d-electron bonding contributions, i.e., the Y or RE metal component, as well as Cu.

The multiphasic product of crystallization consists primarily of an f.c.c. (Au,Cu) solid solution and an unidentified intermetallic phase (or phases) containing the Y component.

The observed $\Delta H_c=1.25$ kJ/g-mole is relatively low, compared to $\Delta H_c=6.2$ kJ/g-mole for the prior art glassy metal $Au_{80}Ge_{12}Si_{08}$. This suggests that strong metal-metal binding and short range order already exist in the glass of the present invention and that this binding is not much increased by crystallization.

Figure 3:
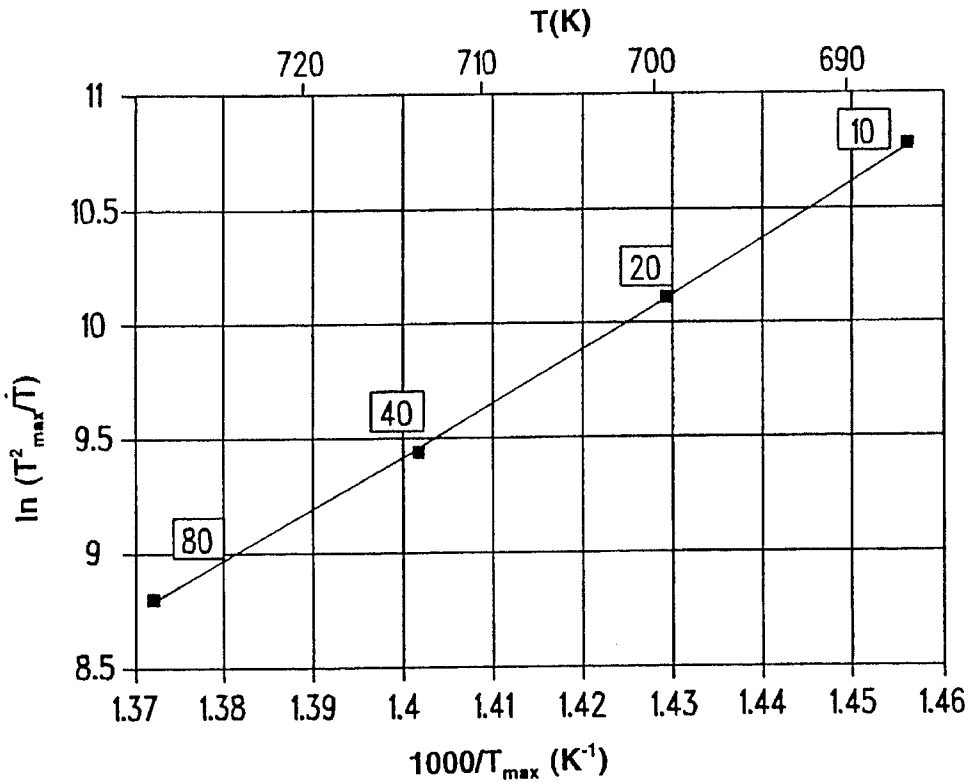
FIG. 3 is a Kissinger plot analysis of the amorphous $Au_{80}Cu_{10}Y_{10}$ of FIG. 1.

A Kissinger plot analysis of the $T_c$ maxima taken at different heating rates T is presented in FIG. 3. It shows good straight-line behavior between 10 and 80K/min and yields an activation energy of crystallization, $E_a=190$ kJ/g-mole. This may be compared to $E_a=152$ kJ/g-mole for the prior art glassy metal $Pd_{82.3}Si_{17.7}$.

EXAMPLE 2

An alloy comprising $Au_{80}Cu_{10}Nd_{10}$ was prepared by the arc furnace quenching technique, described above with respect to Example 1. This alloy was found to be amorphous by the XRD technique described above and was found to have a crystallization temperature $T_c=609$K (at T=20K/min).

The gold glasses of the present invention show good bend ductility at room temperature, bending 180° over a radius of 6 mm. However, they are not tough, fracturing after re-bending.

In the present invention, several thermally stable Ag-rich glasses have also been produced using two glass forming elements, one having an atomic radius smaller than Ag, the other an atomic radius larger than Ag. The preferred smaller glass forming additives are Cu or Si. The preferred larger glass forming additive is chosen from the group consisting of Y and the lanthanides. Each of the Ag-rich amorphous alloys was found to be readily glass forming by rapid solidification processing. The alloys are thermally stable at temperatures below 650K and often at temperatures of up to 800K.

EXAMPLE 3

An alloy comprising $Ag_{80}Cu_{10}Nd_{10}$ was prepared by the arc furnace quenching technique, described above with respect to Example 1. This alloy was found to be amorphous by the XRD technique described above and was found to have a crystallization temperature $T_c=694$K (at T=20K/min).

EXAMPLE 4

An alloy comprising $Ag_{84}Cu_{06}Nd_{10}$ was prepared by the arc furnace quenching technique, described above with respect to Example 1. This alloy was found to be amorphous by the XRD technique described above and was found to have a crystallization temperature $T_c=706$K (at T=40K/min).

EXAMPLE 5

An alloy comprising $Ag_{75}Cu_{10}Y_{15}$ was prepared by the arc furnace quenching technique, described above with respect to Example 1. This alloy was found to be amorphous by the XRD technique described above and was found to have a crystallization temperature $T_c$=778K (at T=40K/min).

EXAMPLE 6

An alloy comprising $Ag_{80}Cu_{10}Y_{10}$ was prepared by the arc furnace quenching technique, described above with respect to Example 1. This alloy was found to be amorphous by the XRD technique described above and was found to have a crystallization temperature $T_c$=798K (at T=40K/min). The observed $\Delta H_c$=0.5 kJ/g-mole is relatively low, and the activation energy of crystallization $E_a$=225 kJ/g-mole is relatively high, compared to the prior art glassy metal $Pd_{82.3}Si_{17.7}$, as noted above in Example 1.

EXAMPLE 7

An alloy comprising $Ag_{75}Cu_{10}Gd_{15}$ was prepared by the arc furnace quenching technique, described above with respect to Example 1. This alloy was found to be amorphous by the XRD technique described above and was found to have a crystallization temperature $T_c$=814K (at T=40K/min).

EXAMPLE 8

An alloy comprising $Ag_{80}Cu_{10}Dy_{10}$ was prepared by the arc furnace quenching technique, described above with respect to Example 1. This alloy was found to be amorphous by the XRD technique described above and was found to have a crystallization temperature $T_c$=804K (at T=40K/min).

EXAMPLE 9

An alloy comprising $Ag_{80}Cu_{10}Y_{02}Nd_{08}$ was prepared by the arc furnace quenching technique, described above with respect to Example 1. This alloy was found to be amorphous by the XRD technique described above and was found to have a crystallization temperature $T_c$=720K (at T=40K/min).

EXAMPLE 10

An alloy comprising $Ag_{80}Cu_{10}Y_{06}Nd_{04}$ was prepared by the arc furnace quenching technique, described above with respect to Example 1. This alloy was found to be amorphous by the XRD technique described above and was found to have a crystallization temperature $T_c$=820K (at T=40K/min).

EXAMPLE 11

An alloy comprising $Ag_{80}Cu_{10}Y_{08}Nd_{02}$ was prepared by the arc furnace quenching technique, described above with respect to Example 1. This alloy was found to be amorphous by the XRD technique described above and was found to have a crystallization temperature $T_c$=809K (at T=40K/min).

Alloy compositions comprising a mixture of Ag and Au are also contemplated by the present invention. A general formula for such alloy compositions is the following:

$$(Au_{1-x}Ag_x)_{1-z}(G1_{1-y}G2_y)_z$$

where x is between 0.0 and 1.0, y is between 0.1 and 0.9 and preferably between 0.2 and 0.8, and z is between 15% and 30%. G1 and G2 refer to the first and second glass forming additives.

EXAMPLE 12

An alloy comprising $Au_{40}Ag_{40}Cu_{10}Nd_{10}$ was prepared by the arc furnace quenching technique, described above with respect to Example 1. The alloy was found to be amorphous by the XRD technique described above.

Alloy compositions rich in the metals Ru, Os, Rh, Ir, Pd, and Pt are also contemplated by the present invention. A general formula for such alloy compositions is the following:

$$(M_{1-x}L_x)_{1-z}(G1_{1-y}G2_y)_z$$

where x is between 0.0 and 1.0, y is between 0.1 and 0.9 and preferably between 0.2 and 0.8, and z is between 15% and 30%. G1 and G2 refer to the first and second glass forming additives. M and L are elements selected from the group consisting of Ru, Os, Rh, It, Pd, and Pt. Preferably, G1 is at least one element selected from the group consisting of B, Cu, Si, and Be, and G2 is at least one element selected from the group consisting of Y, the lanthanides, Zr, Hf, and Mo.

Suitable larger glass forming elements for Ru or Os-rich alloys are Nb, Ta, and W in addition to the Rare Earths, Zr, Hf, and Mo. B has been found to be a suitable smaller glass forming element.

EXAMPLE 13

An amorphous alloy comprising $Ru_{75}Zr_{12.5}B_{12.5}$ was prepared by the arc furnace quenching technique, described above with respect to Example 1. This alloy was found to be amorphous by the XRD technique described above. This alloy exhibits good ductility and a Vickers microhardness of 952 kg/mm$^2$, in addition to being thermally stable with crystallization not detected at temperatures up to 1000K.

The metallic glasses of the present invention are suitable for use in electrical contacts, conductors, and interconnections, where strength and corrosion resistance are required. Also, the glasses are useful (after careful crystallization) to form nanocrystalline precipitates as strengtheners in Au or Ag matrices or (after internal oxidation of rare earths) to form $RE_2O_3$ nanodispersions in Cu-strengthened Ag or Au matrices.

The invention is not to be limited by what has been particularly shown and described, except as indicated in the appended claims.

We claim:

1. An amorphous metal alloy having the formula $$M_aG1_bG2_c,$$

wherein

M is at least one element selected from the group consisting of Ag, Au, Ru, Os, Rh, Ir, and Pd, G1 is at least one element selected from the group consisting of Cu, Ni, Si, and Be, G2 is at least one element selected from the group consisting of Y, the lanthanides, Zr, Hf, Ca, Mg, Ti, Nb, and Ta;

wherein a, b, and c are atomic percentages, a ranges from 70 to 90 percent, b and c range from 5 to 15 percent each, and a +b+c total 100 percent; and wherein the alloy has been produced by rapid solidification from a liquid melt.

2. The amorphous metal alloy of claim 1 wherein b and c are substantially equal.

3. The amorphous metal alloy of claim 1 wherein a is at least 80 atomic percent.

4. The amorphous metal alloy of claim 1 wherein the alloy is thermally stable at temperatures at least as high as 550K.

5. The amorphous metal alloy of claim 1 wherein M comprises Ag or Ru and the alloy is thermally stable at temperatures at least as high as 650K.

6. The amorphous metal alloy of claim 1 wherein M comprises Ru and the alloy is thermally stable at temperatures at least as high as 1000K.

7. An amorphous metal alloy having the formula $$(Au_{1-x}Ag_x)_{100-z}(G1_{1-y}G2_y)_z$$

wherein $0 \leqq x \leqq 1$, $0.1<y<0.9$, $15\%<z<30\%$, and G1 is at least one element selected from the group consisting of Cu, Ni, Si, and Be, and G2 is at least one element selected from the group consisting of Y, the lanthanides, Zr, Hf, Ca, and Mg; and wherein the alloy has been produced by rapid solidification from a liquid melt.

8. The amorphous metal alloy of claim 7 wherein 1−z is at least 80%.

9. The amorphous metal alloy of claim 7 wherein the alloy is thermally stable at temperatures at least as high as 550K.

10. The amorphous metal alloy of claim 7 wherein x=1 and the alloy is thermally stable at temperatures at least as high as 650K.

11. The amorphous metal alloy of claim 7 wherein y is between 0.2 and 0.8.

12. An amorphous metal alloy having the formula $$(M_{1-x}L_x)_{100-z}(G1_{1-y}G2_y)_z$$

wherein $0 \leqq x \leqq 1$, $0.1<y<0.9$, $15\%<z<30\%$,

M and L are each elements selected from the group consisting of Ru, Os, Rh, Ir, and Pd, M and L being different elements;

G1 is at least one element selected from the group consisting of B, Cu, Si, and Be;

G2 is at least one element selected from the group consisting of Y, the lanthanides, Zr, and Hf; and wherein the alloy has been produced by rapid solidification from a liquid melt.

13. The amorphous metal alloy of claim 12 wherein 1−z is at least 80%.

14. The amorphous metal alloy of claim 12 wherein the alloy is thermally stable at temperatures at least as high as 550K.

15. The amorphous metal alloy of claim 12 wherein M comprises Ru and the alloy is thermally stable at temperatures at least as high as 1000K.

16. The amorphous metal alloy of claim 12 wherein y is between 0.2 and 0.8.

* * * * *

UNITED STATES PATENT AND TRADEMARK OFFICE

CERTIFICATE OF CORRECTION

PATENT NO. : 5,593,514

DATED : January 14, 1997

INVENTOR(S) : Bill C. Giessen, et al.

It is certified that error appears in the above-identified patent and that said Letters Patent is hereby corrected as shown below:

Column 3, line 64, "$(Au_{.189}\ Cu_{.11})_{90}Y_{10}$." should read --$(Au_{.89}Cu_{.11})_{90}Y_{10}$.--.

Signed and Sealed this

Eleventh Day of August 1998

Bruce Lehman

*Attest:*

BRUCE LEHMAN

*Attesting Officer*

*Commissioner of Patents and Trademarks*